US007361825B2

(12) United States Patent
Nishida

(10) Patent No.: US 7,361,825 B2
(45) Date of Patent: Apr. 22, 2008

(54) ELECTRONIC KEYBOARD INSTRUMENT

(75) Inventor: Kenichi Nishida, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 82 days.

(21) Appl. No.: 11/504,753

(22) Filed: Aug. 14, 2006

(65) Prior Publication Data

US 2007/0039452 A1 Feb. 22, 2007

(30) Foreign Application Priority Data

Aug. 19, 2005 (JP) ..... 2005-238828

(51) Int. Cl.
*G10H 1/34* (2006.01)

(52) U.S. Cl. ..... 84/626; 84/615; 84/633; 84/653; 84/658; 84/665

(58) Field of Classification Search ..... 84/615, 84/626, 633, 653, 658, 665, 720
See application file for complete search history.

(56) References Cited

U.S. PATENT DOCUMENTS 4,416,178 A 11/1983 Ishida
5,619,005 A 4/1997 Shibukawa et al.

*Primary Examiner*—Lincoln Donovan
*Assistant Examiner*—David S. Warren
(74) *Attorney, Agent, or Firm*—Morrison & Foerster LLP

(57) ABSTRACT

In an electronic keyboard instrument, each key moves from an initial position to a full stroke position via first, second, and third positions sequentially. A velocity detector detects a first key velocity of the key when the key moves from the first position to the second position, and detects a second key velocity of the key when the key further moves from the second position to the third position. A predictor obtains a predicted key-on time and a predicted key velocity based on the first key velocity, provided that the first key velocity is greater than a predetermined threshold velocity. A tone generator generates a musical sound signal based on the first key velocity and the predicted key velocity if the second key velocity is not detected before the predicted key-on time.

4 Claims, 6 Drawing Sheets

ELECTRONIC KEYBOARD INSTRUMENT

BACKGROUND OF THE INVENTION

1. Technical Field of the Invention

The present invention relates to an electronic keyboard instrument and a program suitable for use with an electronic piano.

2. Description of the Related Art

On an acoustic piano, a player can generate a variety of musical sounds that differ according to a variety of articulations. These articulations can be discriminated based on the differences of velocity patterns of a key moving from its initial position toward its full stroke position. Patent References 1 and 2 describe a technology in which a key stroke from the initial position to the full stroke position is divided into a plurality of sections and respective key depression velocities in the plurality of sections are measured to allow an electronic keyboard instrument to discriminate such articulations. In this technology, a sound tone such as a soft or sharp tone is selected according to the plurality of key velocities or alternatively a sound tone is altered by amplifying its nonlinear component.

[Patent Reference 1] Japanese Patent Application Publication No. 61 (1986)-54234, and corresponding U.S. Pat. No. 4,416,178

[Patent Reference 2] Japanese Patent No. 3355743, and corresponding U.S. Pat. No. 5,619,005

However, it is not feasible, in terms of price, to equip popular electronic keyboard instruments with expensive sensors capable of measuring accurate key tracks. Accordingly, popular electronic keyboard instruments generally use sensors that detect about three depression positions on the key track to determine velocities V1 and V2 of two sections between the three depression positions. The conventional electronic keyboard instrument generates a key-on signal and starts synthesizing a musical sound signal at the time when the detection of the first and second velocities V1 and V2 is completed (i.e., when the key position reaches the third contact position). On the other hand, if the key is released when the velocity V1 has been detected and the velocity V2 has not been detected, it is determined that the ongoing key depression operation has been terminated and thus no musical sound signal is generated for the key depression operation.

However, a sophisticated articulation is occasionally performed on an acoustic piano by pressing a key at a very high velocity and releasing it before completing the key-stroke operation. In the acoustic piano, a hammer can reach a string by its inertia if sufficient kinetic energy is transferred from a key to the hammer. Therefore, such a sophisticated articulation in the acoustic piano certainly generates a musical sound. However, the conventional electronic keyboard instrument has a problem in that such a sophisticated articulation generates no musical sound signal since the key position does not reach the third contact position.

Some electronic keyboard instruments include hammer mechanisms, which simulate those of acoustic pianos, and sensors for measuring velocities of hammers included in the hammer mechanisms. These electronic keyboard instruments do not have the above problem since they obtain the hammer velocity through actual measurement in response to a key depression operation performed to generate a musical sound. However, the hammer mechanism complicates the structure of the electronic keyboard instrument and increases the cost thereof. Thus, most popular electronic keyboard instruments do not adopt hammer mechanisms.

SUMMARY OF THE INVENTION

Therefore, the present invention has been made in view of the above circumstances, and it is an object of the present invention to provide an electronic keyboard instrument and a program that can be designed at a very low cost and that can properly generate a musical sound signal even when a player releases a key before completing a key-stroke operation.

In order to solve the above problems, the present invention is characterized by the following. In accordance with the present invention, there is provided an electronic keyboard instrument operative with reference to a threshold velocity for generating a musical sound signal. The inventive electronic musical instrument comprises: a key that moves from an initial position to a full stroke position via first, second, and third positions sequentially when the key is depressed; a velocity detector that detects a first key velocity of the key when the key moves from the first position to the second position, and detects a second key velocity of the key when the key further moves from the second position to the third position; a predictor that obtains a predicted key-on time and a predicted key velocity based on the first key velocity, provided that the first key velocity is equal to or greater than the threshold velocity which is predetermined for control of generating of the musical sound signal; a first generator that generates the musical sound signal based on the first key velocity and the second key velocity if the first key velocity is equal to or greater than the threshold velocity and the second key velocity is detected before the predicted key-on time; and a second generator that generates the musical sound signal based on the first key velocity and the predicted key velocity if the first key velocity is equal to or greater than the threshold velocity and the second key velocity is not detected before the predicted key-on time.

Further, the first generator generates the musical sound signal based on the first key velocity and the second key velocity if the first key velocity is less than the threshold velocity and the second key velocity is detected.

Preferably, the predictor calculates the predicted key velocity based on the first key velocity such that the predicted key velocity increases as the first key velocity increases, and calculates the predicted key-on time based on the first key velocity such that a time interval from a time at which the first key velocity is detected to the predicted key-on time decreases as the first key velocity increases.

The invention includes a machine readable medium for use in an electronic keyboard instrument having a key which moves from an initial position to a full stroke position via first, second, and third positions sequentially when the key is operated, a tone generator for generating a musical sound signal in response to operating of the key, and a processor for controlling the tone generator with reference to a threshold velocity which is predetermined for control of the tone generator. The inventive machine readable medium contains program instructions executable by the processor for causing the electronic musical instrument to perform: a detection process of detecting a first key velocity of the key when the key moves from the first position to the second position; a prediction process of obtaining a predicted key-on time and a predicted key velocity based on the first key velocity, provided that the first key velocity is equal to or greater than the threshold velocity; a first generation process of providing a parameter corresponding to the first key velocity and the second key velocity to the tone generator for generating the musical sound signal, if the first key velocity is equal to or greater than the threshold velocity and the second key velocity is detected before the predicted key-on time, or if the first key velocity is less than the threshold velocity and the second key velocity is detected; and a second generation process of providing a parameter corresponding to the first key velocity and the predicted key velocity to the tone generator for generating the musical sound signal if the first key velocity is equal to or greater than the threshold velocity and the second key velocity is not detected before the predicted key-on time.

In accordance with the present invention, the predicted key velocity and the predicted key-on time are obtained based on the first key velocity if the first key velocity is equal to or greater than the specific threshold sound generating velocity, and a musical sound signal is synthesized based on the first key velocity and the predicted key velocity if the second key velocity is not detected before the predicted key-on time. This allows a musical sound signal to be generated properly even if a player releases the key before completing a key-stroke operation.

DETAILED DESCRIPTION OF THE INVENTION

1. Principle of Embodiment

Figure 4A:
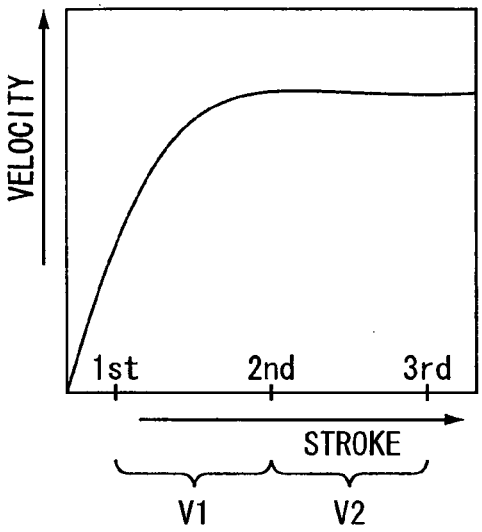
FIGS. 4*a*-4*d* are graphs illustrating changes of key velocities according to a variety of articulations.
Figure 4B:
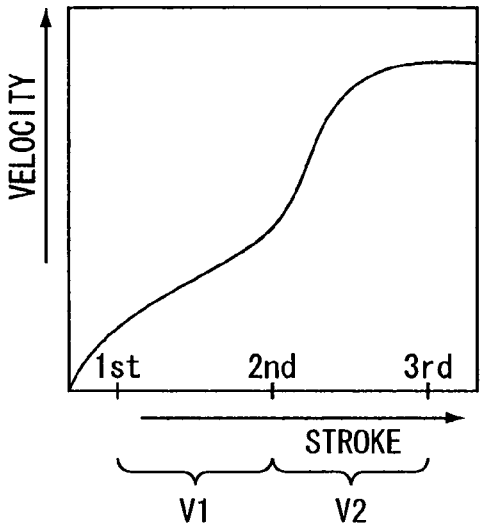
Figure 4C:
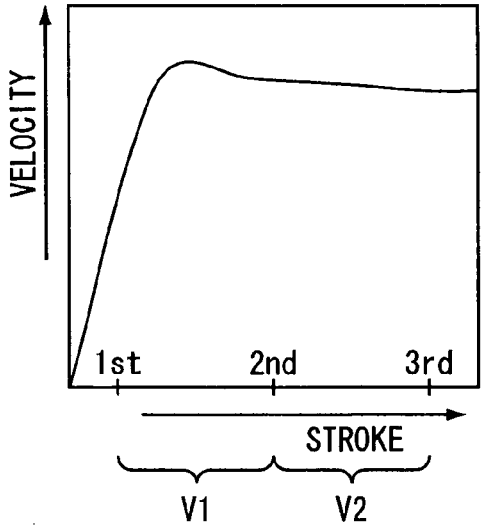
Figure 4D:
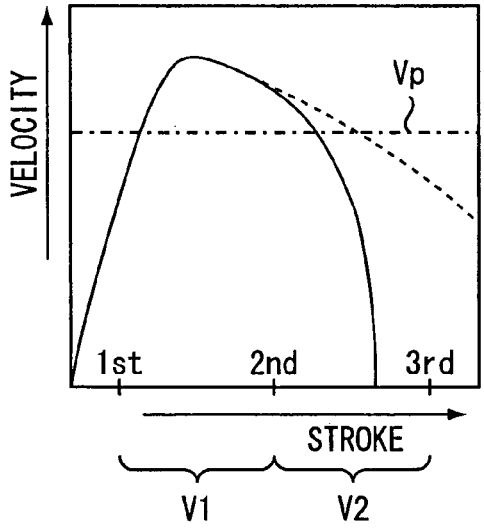

Principle of the invention is first described with reference to FIGS. 4*a*, 4*b*, 4*c* and 4*d*. FIGS. 4*a*-4*d* illustrate example velocity changes in a variety of articulations. The accurate key depression velocities of the articulations are as shown by solid lines. The inventive electronic keyboard instruments use sensors that detect about three depression positions on the key track (first to three contact positions denoted by "1st", "2nd", "3rd" in the drawings) to determine velocities V1 and V2 of two sections between the three depression positions. FIG. 4*a* indicates normal touch playing, FIG. 4*b* depicts heavy touch playing, FIG. 4*c* depicts light touch playing, and FIG. 4*d* shows very light touch playing.

When an articulation shown by a solid line of FIG. 4*d* is performed with a key on an acoustic piano, the key is released during an ongoing key-stroke operation so that the key does not reach a full stroke position. Considering the movement of a hammer when this articulation is performed, it is theoretically possible to continuously depress the key to its full stroke position while no additional kinetic energy is given to the hammer. A velocity limit at which no additional kinetic energy is given to the hammer is referred to as an "energizing velocity limit", which is shown by a dash line in FIG. 4*d*.

In other words, if the key is depressed at a velocity higher than the energizing velocity limit, additional kinetic energy is given to the hammer so that the hammer velocity at the moment of striking the string exceeds that of the articulation shown by the solid line. However, the articulation shown by the solid line of FIG. 4*d* requires that the key depression operation performed before completing the key-stroke action give sufficient kinetic energy to the hammer. A threshold velocity to give such kinetic energy is referred to as a threshold sound generating velocity Vp, which is shown by a chain line in FIG. 4*d*. That is, it is possible to perform the articulation shown by the solid line of FIG. 4*d* if the velocity V1 is equal to or greater than the threshold sound generating velocity Vp.

In an electronic keyboard instrument that simulates the above operation of the acoustic piano, if the velocity V1 exceeds the threshold sound generating velocity Vp, it is possible to predict a velocity V2 based on the energizing velocity limit characteristics shown by the dash line and also to predict a time t3' at which the key position reaches the third contact position. In the case of FIG. 4*d*, the velocity V1 is measured as an average of solid-line key velocities between the first and second contacts. Actually, if the key position reaches the third contact position at a timing earlier than the predicted time t3', i.e., if an articulation shown in FIG. 4*c* is performed, a musical sound signal is generated based on actually measured velocities V1 and V2 as usual. On the other hand, if the key position does not reach the third contact position even after the current time reaches the predicted time t3', it is determined that the articulation shown by the solid line in FIG. 4*d* has been performed, and a sound generation parameter is selected based on the actually measured velocity V1 and the predicted velocity V2' and a key-on signal is immediately generated. Accordingly, even when an articulation to release a key before completing a key-stroke operation is performed, it is possible to generate a musical sound signal intended by the player at a timing intended by the player.

2. Configuration of Embodiment

The configuration of an electronic keyboard instrument according to an embodiment of the present invention will now be described with reference to FIG. 1.

Figure 1:
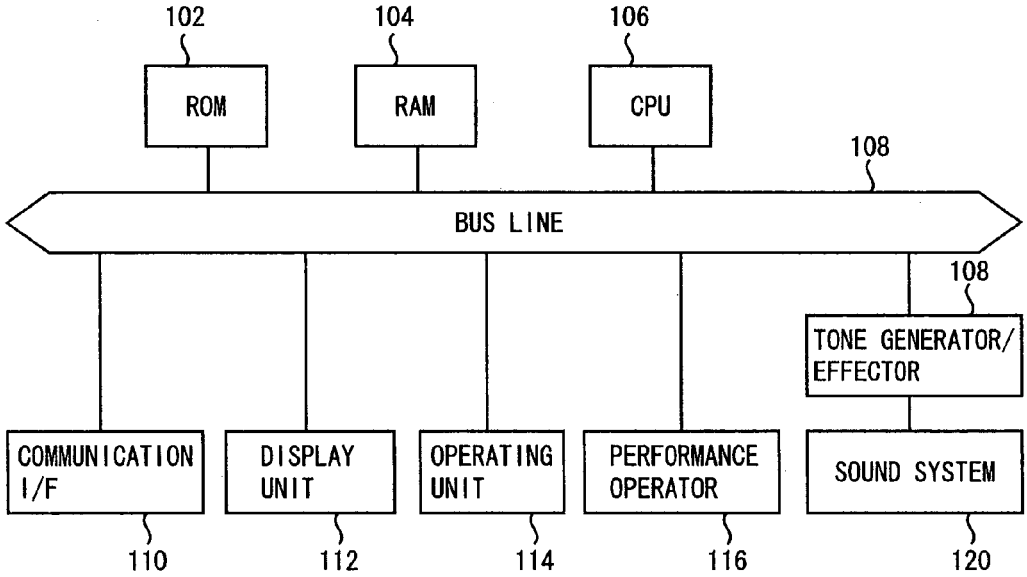
FIG. 1 is a block diagram of an electronic keyboard instrument according to an embodiment of the present invention.

In FIG. 1, reference numeral "106" denotes a CPU that controls the other components of the electronic keyboard instrument via a bus 108 according to a program stored in a ROM 102. The ROM 102 also stores a plurality of types of waveform data corresponding to articulations, envelope parameters used to generate envelope signals, filtering coefficients, which specify filtering processes, and the like. Reference numeral "104" denotes an RAM which is used as a work memory of the CPU 106. "110" denotes a communication interface through which MIDI signals or the like are input and output. "112" denotes a display unit that displays a variety of user information. "114" denotes an operating unit that includes a variety of switches, knobs, and the like. "116" denotes a performance operator that includes a performance keyboard or the like. "118" denotes a tone generator/effector unit that synthesizes a musical sound signal based on a control signal provided from the CPU 106 and also adds required effects to the musical sound signal. "120" denotes a sound system that generates a sound corresponding to the generated musical sound signal.

Figure 2:
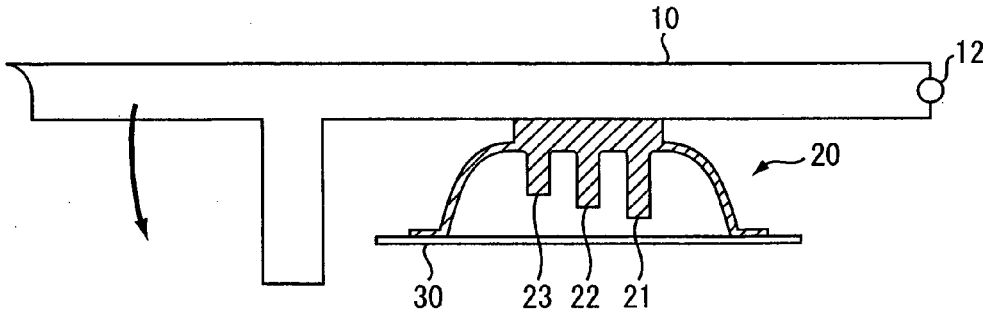
FIG. 2 is a side view of a keyboard structure in the embodiment.

A keyboard structure in the performance operator 116 will now be described with reference to FIG. 2. In FIG. 2, reference numeral "10" denotes a key that is rotatably supported by a key support 12 about the key support 12. A rubber dome 20, which is a dome-shaped piece of rubber, is fixed to the bottom of the key 10. Columnar pressing portions 21, 22, and 23, which are sequentially shortened, are downwardly protruded from an inner upper surface of the rubber dome 20. Reference numeral "30" denotes a fixed switch on a substrate, which is formed through patterning. The switch 30 may be a membrane switch mounted on a frame (not shown). First, second, and third contacts are formed on the switch 30 at corresponding positions under the pressing portions 21, 22, and 23. Keys 10, each being configured as described above, are mounted on the performance operator 116. The CPU 106 always monitors the respective states of the first to third contacts of the switch 30 of each key. In FIG. 2, the size of each of the rubber dome 20 and the switch 30 of the key 10 is drawn to be greater than that of actual ones for easier explanation.

As the key 10 configured as described above is depressed to move from its initial position to its full stroke position, the rubber dome 20 is gradually bent and crushed. This causes the pressing portions 21, 22, and 23 to sequentially depress the switch 30, thereby sequentially turning on the first to third contacts on the switch 30. When the rubber dome 20 is depressed, it applies a repulsive force to the key 10. Accordingly, if a player releases the key 10, the key 10 returns to the initial position. Let "t1", "t2", and "t3" be times at which the first, second, and third contacts of the switch 30 are turned on and let a time interval "T1" be equal to "t2−t1" (i.e., T1=t2−t1) and a time interval T2 be equal to "t3−t2" (T2=t3−t2).

Since key stroke actions between the times when the first, second, and third contacts are turned on are known from the structure of the rubber dome 20, a velocity "V1" between the first and second contact positions and a velocity "V2" between the second and third contact positions can be obtained directly from the times "T1" and "T2". To accurately identify the variety of articulations shown in FIGS. 4*a*-4*d*, it is desirable that the length of the pressing portion 21 be set to allow the first contact to be turned on within a third of the full stroke.

An algorithm run in the CPU 106 and the tone generator/effector unit 118 will now be described with reference to FIG. 3.

Figure 3:
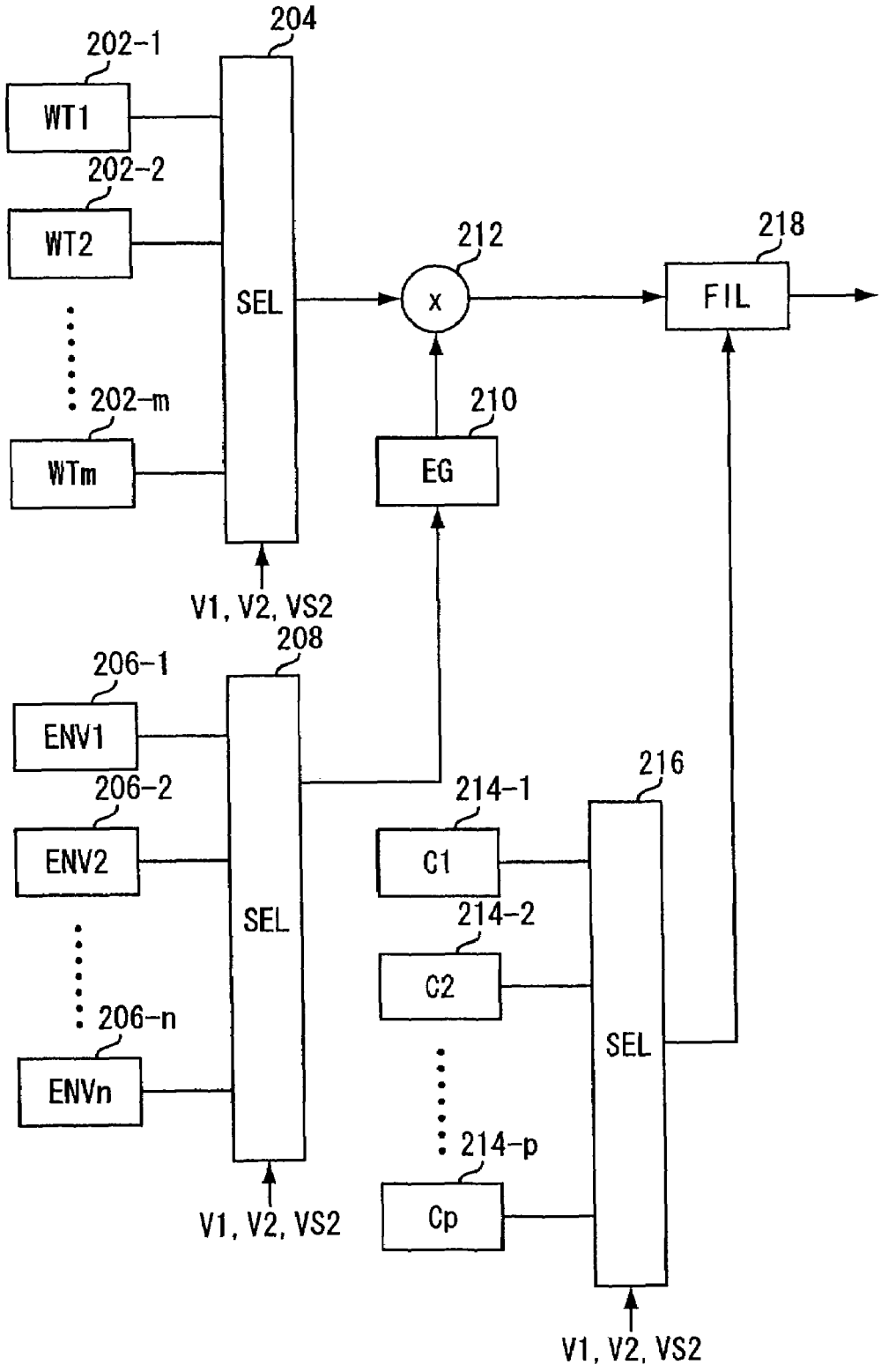
FIG. 3 is a block diagram illustrating an algorithm in the embodiment.

In FIG. 3, reference numerals "202-1" to "202-*m*" denote waveform memories that store m types of waveform data based on a variety of articulations. Reference numeral "204" denotes a selector that selects waveform data based on velocities V1 and V2 and a velocity type VS2. The following is a description of the velocity type. In principle, the velocities V1 and V2 are determined based on the times when the first to third contacts of the switch 30 are turned on. However, the velocity V1 or V2 may be determined through prediction without using the times when the first to third contacts are turned on. A value, which is set to "0" when a corresponding velocity V1 or V2 is a measured value and is set to "1" when the velocity V1 or V2 is a predicted value, is referred to as a velocity type VS1 or VS2. In the algorithm of FIG. 3, the velocity type VS2 is used to select waveform data or the like.

Reference numerals "206-1" to "206-*n*" denote envelope parameter memories that store n sets of envelope parameters used to generate envelopes. Reference numeral "208" denotes a selector that selects an envelope parameter based on the velocities V1 and V2 and the velocity type VS2. "210" denotes an envelope generator that generates an envelope signal based on the envelope parameter received through the selector 208. "212" denotes a multiplier that multiplies the envelope signal by waveform data output through the selector 204, thereby giving a corresponding envelope to the waveform data, and outputs the resulting signal as a musical sound signal. "214-1" to "214-*p*" denote coefficient memories that store p sets of filtering coefficients used to perform filtering processes. "216" denotes a selector that selects a filtering coefficient based on the velocities V1 and V2 and the velocity type VS2. "218" denotes a digital filter that performs filtering on a musical sound signal output from the multiplier 212 based on the selected filtering coefficient.

3. Operation of Embodiment

The operation of this embodiment will now be described with reference to FIG. 5, which is a state transition diagram illustrating the states of the key 10 detected by the CPU 106. Let "ST100" be a state of the key 10 when it is positioned near its initial position so that all the first to third contacts of the switch 30 are turned off. When the key 10 is a little depressed, the first contact is turned on with the second and third contacts off. Let this state be "ST102". When the state of the key 10 transitions from ST100 to ST102, the CPU 106 detects the ON time "t1" of the first contact and writes it in a specific area of the RAM 104. If the key 10 is released at the state S102, the key 10 returns to the state S100.

Figure 6:
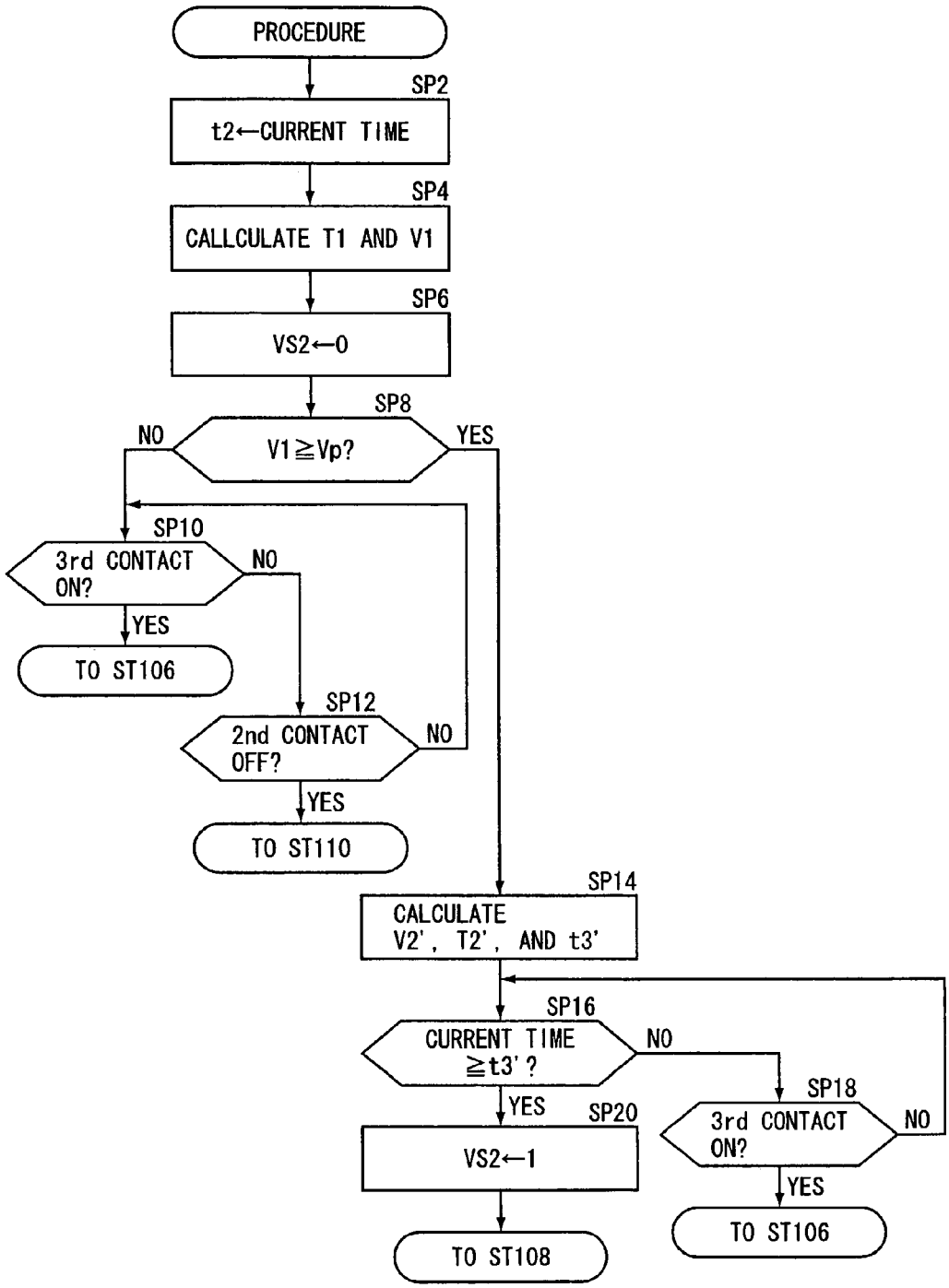
FIG. 6 is a flow chart of a procedure according to the invention.

When the key 10 is further depressed from the state ST102, the second contact is turned on. Let this state be "ST104". A procedure routine shown in FIG. 6 is activated when the key 10 reaches the state ST104. When the procedure of FIG. 6 proceeds to step SP2, the current time is stored as an ON time "t2" of the second contact in the RAM 104. The procedure then proceeds to step SP4 to determine a time interval T1 and a velocity V1 based on the times t1 and t2. The procedure then proceeds to step SP6 to initialize a velocity type VS2 to "0". The procedure then proceeds to step SP8 to determine whether or not the velocity V1 is equal to or greater than a threshold sound generating velocity Vp.

When the determination of step SP8 is NO, the procedure proceeds to step SP10 and repeats a routine of steps SP10 and SP12 until a condition that the third contact be on or a condition that the second contact be off is satisfied. If the third contact is turned on, the determination of step SP10 is YES, so that the key 10 transitions to the state ST106. This is a state at which a normal key-on operation is performed, which is described in detail below. If the second contact is turned off, the determination of step SP12 is YES, so that the key 10 transitions to the state ST110. As is described in detail below, the state ST110 is a state at which a key-off operation is performed and a process for muting a musical sound signal is performed. However, since no musical sound signal has been generated from the beginning, this key depression operation does not generate any musical sound signal at the state ST104.

Figure 7A:
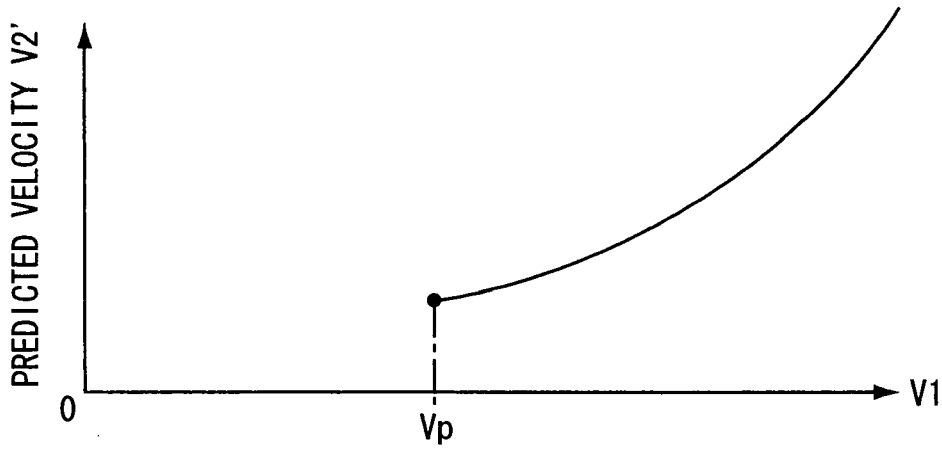
FIGS. 7*a* and 7*b* are characteristic diagrams of a predicted velocity and a predicted key-on time interval.
Figure 7B:
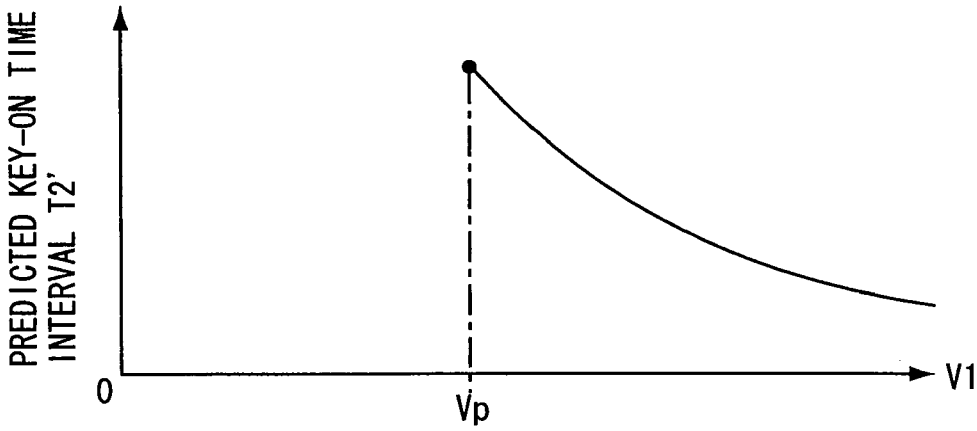

If the velocity V1 is equal to or greater than the threshold sound generating velocity Vp, the determination of step SP8 is YES and the procedure proceeds to step SP14. At step SP14, a predicted velocity V2' corresponding to an average velocity between the second and third contact positions and a predicted key-on time interval T2' in which the key moves from the second contact position to the third contact position are calculated based on the energizing velocity limit characteristics shown by the dash line in FIG. 4*d*. Here, a predicted key-on time t3' is also obtained by adding the time interval T2' to the previously obtained second contact on-time t2. As shown in FIG. 7*a*, the predicted velocity V2' is a monotone increasing function of the velocity V1 and the predicted key-on time interval T2' is a monotone decreasing function of the velocity V1.

As shown in FIG. 6, the procedure then repeats a routine of steps SP16 and SP18 until a condition that the current time be equal or greater than the predicted key-on time t3' or a condition that the third contact be on is satisfied. If the third contact is turned on, the determination of step SP18 is YES, so that the key 10 transitions to the state ST106 at which a normal key-on operation is performed. If the current time is equal to or greater than the predicted key-on time t3 before an ON state of the third contact is detected, the determination of step SP16 is YES, so that the procedure proceeds to step SP20. At step SP20, the velocity type VS2 is set to "1" indicating that the velocity V2 is a predicted value, and the key transitions to a state ST108 at which a key-on signal is generated based on prediction.

Figure 5:
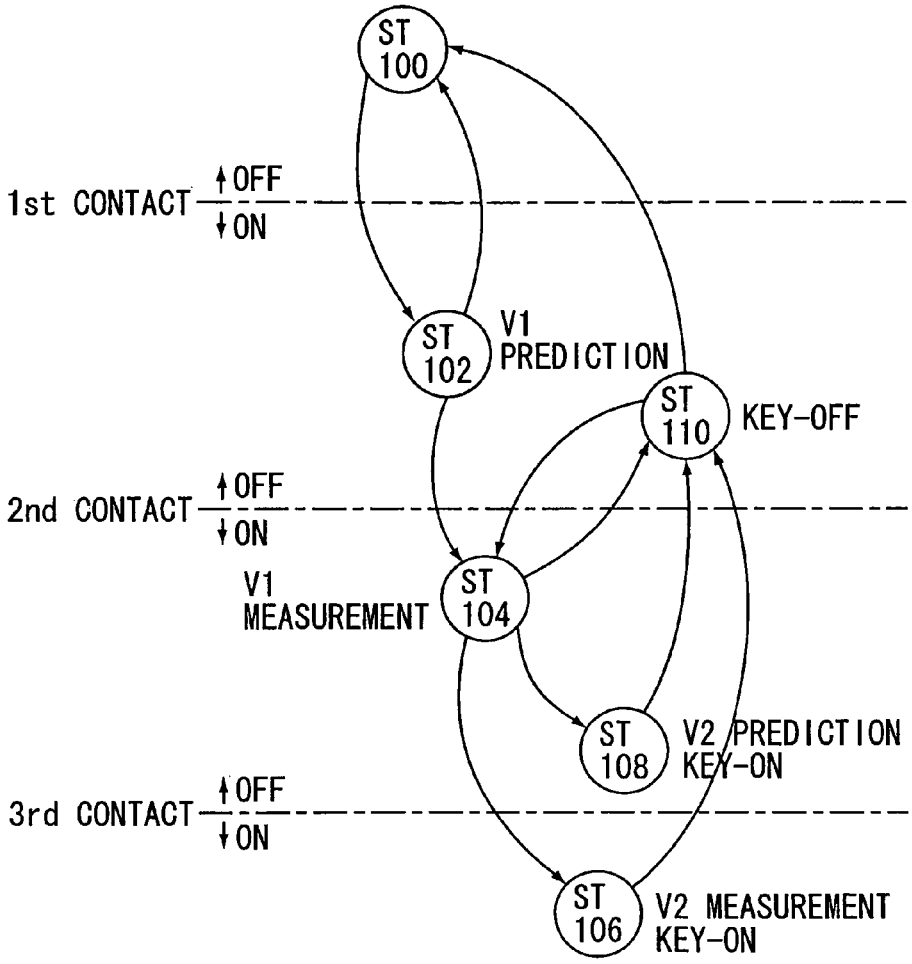
FIG. 5 is a state transition diagram in the embodiment.

Referring to FIG. 5, if the key transitions from the state ST104 to ST106, a key-on process is performed based on actually measured velocities V1 and V2. Specifically, the tone generator/effector unit 118 secures a new sound generation channel and performs the algorithm shown in FIG. 3 for the sound generation channel to synthesize a musical sound signal and then to generate a corresponding sound through the sound system 120. As described above, the selectors 204, 208, and 216 select waveform data, an envelope parameter, and a filtering coefficient based on a combination of the velocities V1 and V2 and the velocity type VS2 "0".

Once the key transitions from the state ST104 to ST108, a key-on process is performed based on the velocity V1 and a predicted velocity V2'. Specifically, the tone generator/effector unit 118 secures a new sound generation channel and performs the algorithm shown in FIG. 3 for the sound generation channel in the same manner as at the state ST106. Here, the predicted velocity V2' is assigned to the velocity V2. In this case, the selectors 204, 208, and 216 select waveform data, an envelope parameter, and a filtering coefficient corresponding to "very light touch playing" since the velocity type VS2 is "1".

At either the state ST106 or ST108, if an OFF state of the second contact is detected, the key transitions to the state ST110 and a key-off process is performed. Specifically, when a sound generation channel has been secured for the key 10, a musical sound signal of the sound generation channel is gradually attenuated, and the sound generation channel is then opened. Further, if an OFF state of the first contact is detected, the key transitions to the initial state ST100. In the acoustic piano, it is possible to repeatedly play a key without returning the key to its initial state. Thus, it is preferable that the electronic keyboard instrument can cope with such playing. If the key 10 is depressed again at the state ST110, the key 10 transitions to the state ST104. In this case, a certain value less than the threshold sound generating velocity Vp is assigned to the velocity V1 since the velocity V1 is not obtained from actual measurement.

4. Modification

The present invention is not limited to the above embodiment. The following are examples of a variety of possible modifications.

(1) A variety of processes are performed by a program run in the CPU 106 in the above embodiment. However, it is also possible to distribute the program instructions via a machine readable medium such as a CD-ROM and a flexible disk, which stores the program, or via a transmission route.

(2) A velocity detector for detecting the key velocity is not limited to the rubber dome 20 and the switch 30 used in the above embodiment. For example, the velocity detector may also use an optical sensor, a solenoid sensor, or the like.

In accordance with the present invention, the electronic keyboard instrument comprises a key (10) that moves from an initial position to a full stroke position via first, second, and third positions sequentially when depressed; a velocity detector (20, 30, and 106) that detects a first key velocity (V1) of the key when the key moves from the first position to the second position and a second key velocity (V2) of the key when the key moves from the second position to the third position; a predictor (106 and SP14) that obtains a predicted key-on time (t3') and a predicted key velocity (V2') based on the first key velocity (V1), provided that the first key velocity (V1) is equal to or greater than a specific threshold sound generating velocity (Vp); a first generator (state ST106) that generates a musical sound signal based on the first key velocity (V1) and the second key velocity (V2) if the first key velocity (V1) is equal to or greater than the threshold sound generating velocity (Vp) and the second key velocity (V2) is detected before the predicted key-on time (t3') or if the first key velocity (V1) is less than the threshold sound generating velocity (Vp) and the second key velocity (V2) is detected; and a second generator (state ST108) that generates a musical sound signal based on the first key velocity (V1) and the predicted key velocity (V2') if the first key velocity (V1) is equal to or greater than the threshold sound generating velocity (Vp) and the second key velocity (V2) is not detected before the predicted key-on time (t3'). The predicted key velocity (V2') increases as the first key velocity (V1) increases, and a time interval (predicted key-on time interval T2') from a time at which the first key velocity (V1) is detected to the predicted key-on time (t3') decreases as the first key velocity (V1) increases.

What is claimed is:

1. An electronic keyboard instrument operative with reference to a threshold velocity for generating a musical sound signal, comprising:

a key that moves from an initial position to a full stroke position via first, second, and third positions sequentially when the key is depressed;

a velocity detector that detects a first key velocity of the key when the key moves from the first position to the second position, and detects a second key velocity of the key when the key further moves from the second position to the third position;

a predictor that obtains a predicted key-on time and a predicted key velocity based on the first key velocity, provided that the first key velocity is equal to or greater than the threshold velocity which is predetermined for control of generating of the musical sound signal;

a first generator that generates the musical sound signal based on the first key velocity and the second key velocity if the first key velocity is equal to or greater than the threshold velocity and the second key velocity is detected before the predicted key-on time; and a second generator that generates the musical sound signal based on the first key velocity and the predicted key velocity if the first key velocity is equal to or greater than the threshold velocity and the second key velocity is not detected before the predicted key-on time.

2. The electronic keyboard instrument according to claim 1, wherein the first generator generates the musical sound signal based on the first key velocity and the second key velocity if the first key velocity is less than the threshold velocity and the second key velocity is detected.

3. The electronic keyboard instrument according to claim 1, wherein the predictor calculates the predicted key velocity based on the first key velocity such that the predicted key velocity increases as the first key velocity increases, and calculates the predicted key-on time based on the first key velocity such that a time interval from a time at which the first key velocity is detected to the predicted key-on time decreases as the first key velocity increases.

4. A machine readable medium for use in an electronic keyboard instrument having a key which moves from an initial position to a full stroke position via first, second, and third positions sequentially when the key is operated, a tone generator for generating a musical sound signal in response to operating of the key, and a processor for controlling the tone generator with reference to a threshold velocity which is predetermined for control of the tone generator, the machine readable medium containing program instructions executable by the processor for causing the electronic musical instrument to perform:

a detection process of detecting a first key velocity of the key when the key moves from the first position to the second position;

a prediction process of obtaining a predicted key-on time and a predicted key velocity based on the first key velocity, provided that the first key velocity is equal to or greater than the threshold velocity;

a first generation process of providing a parameter corresponding to the first key velocity and the second key velocity to the tone generator for generating the musical sound signal, if the first key velocity is equal to or greater than the threshold velocity and the second key velocity is detected before the predicted key-on time, or if the first key velocity is less than the threshold velocity and the second key velocity is detected; and a second generation process of providing a parameter corresponding to the first key velocity and the predicted key velocity to the tone generator for generating the musical sound signal if the first key velocity is equal to or greater than the threshold velocity and the second key velocity is not detected before the predicted key-on time.

* * * * *